United States Patent [19]

Harris

[11] 3,976,127

[45] Aug. 24, 1976

[54] HEAT EXCHANGER ASSEMBLIES

[75] Inventor: Peter John Harris, Birmingham, England

[73] Assignee: GKN Birwelco Limited, Halesowen, England

[22] Filed: Dec. 6, 1974

[21] Appl. No.: 530,391

[30] Foreign Application Priority Data

Dec. 8, 1973 United Kingdom ..... 57001/73

[52] U.S. Cl. ..... 165/125; 165/DIG. 1; 165/176; 165/DIG. 5

[51] Int. Cl.[2] ..... F28B 1/06

[58] Field of Search ..... 165/172, 110, 124, 122, 165/125, DIG. 1, 129, 176, DIG. 5

[56] References Cited

UNITED STATES PATENTS

| | | | |
|---|---|---|---|
| 2,608,388 | 8/1952 | Miller | 165/172 X |
| 3,212,288 | 10/1965 | Herbert | 165/124 X |
| 3,384,165 | 5/1968 | Mathews | 165/DIG. 1 |
| 3,400,917 | 9/1968 | Richards | 165/129 X |
| 3,519,068 | 7/1970 | Harris et al. | 165/122 X |
| 3,814,177 | 6/1974 | Harris et al. | 165/110 |

*Primary Examiner*—Albert W. Davis, Jr.
*Attorney, Agent, or Firm*—Spencer & Kaye

[57] ABSTRACT

A heat exchanger comprising an A or V frame with finned tubes running parallel with the apex of the V in which the apex of the frame is filled with tubes rather than being blanked off thus increasing the available heat-exchange area. Also an assembly of such heat exchangers arranged side by side to have a zig-zag section and in which all apices of the section are tubed. An assembly or assemblies of such heat exchangers may be arranged in a natural draught tower or have fan means associated therewith.

11 Claims, 11 Drawing Figures

HEAT EXCHANGER ASSEMBLIES

BACKGROUND OF THE INVENTION

1. Field of the Invention

This invention relates to a heat exchanger of the kind hereinafter referred to as being of the kind specified, in which fluid to be cooled is passed through finned tubes over which air flows, the air flow being assisted by a natural draught tower and/or by fan or other means for providing a forced or induced draught.

A heat exchanger of the kind specified also comprises a plurality of finned tubes, the tubes being grouped together into banks, each bank comprising a plurality of parallel, finned tubes arranged side by side, two such banks being associated with one another to form a frame, the banks being inclined to one another so that they diverge from an apex of the frame, the tubes of each bank being arranged with their longitudinal axes generally parallel to the apex of the frame.

The fluid to be cooled by the heat exchanger may change its state, i.e. be condensed, or may be cooled without change of state. Such heat exchangers find application in condensing steam and/or cooling condensate from steam turbines.

2. Description of the prior art

Heretofore each bank of tubes has comprised supporting frame members extending parallel to the tubes and connected at their ends to headers with which the ends of the tubes are also connected. The frame members adjacent the apex of the frame have been connected by a blanking plate. When a plurality of frames have been arranged side by side to form a heat-exchanger assembly, blanking plates have also been connected between the frame members of adjacent banks of adjacent frames. Where the frames have been arranged with the apices generally horizontal so that there are upper and lower supporting frame members of each bank, the lower frame members of adjacent banks have been connected by blanking plates as have the upper frame members of adjacent banks. Moreover, adjacent lower frame members have been supported on beams of a supporting framework extending parallel to and below the lower frame members. In this arrangement the frames are A-frames or V-frames with the banks diverging downwardly and upwardly respectively from the apex of the frame.

In such an assembly of A-frames or V-frames, which presents a zig-zag shape in vertical section, the inclined flanks of the shape contain the finned tubes over which the air flows but the upper and lower apices of the shape are formed by the upper and lower supporting frame members and blanking plates and therefore represent wasted parts of the plan area (i.e. horizontal projected area) of the heat-exchanger assembly since they provide no heat-exchange surface.

An object of one aspect of the invention is to provide a heat exchanger of the kind specified which has more usuable heat exchange surface than previously known heat exchangers of this kind.

SUMMARY OF THE INVENTION

According to the invention we provide a heat exchanger of the kind specified wherein the finned tubes of the banks substantially fill the apex of the frame and are arranged so that air can flow through the apex in a direction generally parallel to a median plane of the frame parallel to the tubes bisecting the angle between the banks, the air in flowing through said apex passing over a plurality of tubes in succession.

By having finned tubes at the apex of the frame, the heat-exchange surface is increased as compared with the prior constructions referred to above where there is a blanking plate between supporting frame members of the frame.

The tubes in the apex will be arranged in staggered rows so that the actual path of air flow over the tubes in the apex will be serpentine but the general direction of flow will be parallel to the median plane of the frame.

It is necessary to support the tubes by transverse supports extending transversely of the tubes at intervals, e.g. every 6 feet, along the tube bank. The tubes are provided with collars, e.g. of zinc, at the positions at which the tubes are supported.

According to a further feature of the invention, the tubes of each blank are supported between headers by a plurality of pairs of aligned transverse supports, the pairs of supports being spaced apart along the length of the tubes and arranged so that the latter lie between the supports of each pair, the pairs of supports of one bank being aligned with the pairs of supports of the other bank and the supports of each two aligned pairs being connected to a common member lying about the median plane of the frame and passing between the tubes immediately adjacent to said plane at the apex of the frame.

Various header arrangements may be used for the frame. In one such arrangement, each bank of tubes has a separate header at each end to which the tubes of the bank are connected and at the apex of the frame the headers have adjacent surfaces parallel to the median plane of the frame, the headers being connected to a common member. One header of each bank may be divided and provided with inlet and outlet nozzles.

In an alternate arrangement, the banks of the frame have a common header at each end of the frame to which the tubes of the frame are connected. In this arrangement, one of the headers may be divided and have a common inlet nozzle for both banks at the apex of the frame and separate outlet nozzles.

Preferably, adjacent common members spaced apart along the frames are connected together. This helps to give the frame stability longitudinally thereof. Preferably, also, the common members include, or are in the form of, plates lying substantially in the median plane of the frame. By having the common members as plates, very little obstruction is put in the way of the airflow through the tubes of the frame.

It is an object of a second aspect of the invention to provide a heat-exchanger assembly comprising a plurality of heat exchangers according to the first aspect of the invention and which has more usuable heat-exchanger surface than previously known heat exchanger assemblies of heat exchangers of the kind specified.

According to this aspect of the invention we provide a heat exchanger assembly comprising a plurality of heat-exchangers constructed according to the first aspect of the invention and arranged side by side so that the assembly has a zig-zag shape in section perpendicular to the length of the tubes and wherein each apex of the shape is substantially filled with the finned tubes of adjacent banks so that air can flow through the apex in a direction generally parallel to a median plane of the apex parallel to the tubes and bisecting the angle between the banks meeting at said apex, the air when flowing through said apex passing over a plurality of said tubes in succession.

Where the frames have the pairs of aligned transverse supports as described above, at each apex formed by adjacent banks of adjacent frames, the transverse supports of the adjacent banks are aligned and are connected to a common member lying about the median plane of the apex and passing between the tubes immediately adjacent to said plane of said apex. It will be apparent, therefore, that the interconnection of the transverse supports of adjacent frames is preferably similar to the interconnection of the transverse supports of the banks of each frame.

Preferably, also, at each apex formed by adjacent banks of adjacent frames, the headers of the adjacent banks have surfaces parallel to the median plane of said apex which surfaces engage a common member lying between the surfaces and about the median plane, the headers being connected to the common member.

In a preferred arrangement, the frames of the assembly are arranged as A-frames or V-frames with the banks diverging from the upper or lower apices of the frames. We have found that, in such an arrangement, the air velocity tends to increase as the air flows to and through the upper apices of the assembly. By replacing the blanking plates previously used at said upper apices with finned tubes, the distribution of air flow past the tubes in the vicinity of said apices becomes more even.

Preferably, the assembly includes a supporting framework having longitudinal support members extending parallel to the tubes and aligned with the lower apices of the assembly, the support members being provided with a plurality of upstanding columns on which the frame members are supported with the lower apices of the assembly spaced above the longitudinal support members. By spacing the lower apices above the longitudinal support members the latter do not blank the flow through the tubes at the lower apices of the assembly.

Preferably, means are provided for interconnecting adjacent upper apices of the assembly. We have found that if the frames are arranged as V-frames then they can be very stably supported on their lower apices if the upper apices of the assembly, which are formed by connecting the upper ends of adjacent V's, are interconnected.

Where common members are provided at the upper apices then these can conveniently be connected to stabilize the frames.

Where common members are provided at the lower apices then these may be connected to the columns which space the lower apices from the longitudinal support members.

The invention also includes the combination of a heat exchanger or a heat exchanger assembly according to either of the above aspects of the invention with means, e.g. fan means, to force or induce a flow of air over the tubes.

The invention further includes the combination of at least one heat exchanger according to the second aspect of the invention with a natural-draught tower comprising a chimney part and apertured support means between the lower end of the chimney part and the ground, the heat exchanger assembly being arranged within the lower part of the tower and spaced above the ground so that air can enter the tower through the support means and pass across the bottom of the heat exchanger assembly and flow upwardly through the heat exchanger assembly.

By spacing the heat exchanger assembly or assemblies above the ground, the performance thereof is rendered less wind sensitive. When a combination of tower and heat exchanger elements is operating there is always some wind which will affect the performance of the heat exchangers.

In a preferred arrangement, a plurality of heat exchanger assemblies are arranged so that there is an outer ring of heat exchanger assemblies at a higher level above the ground surrounding one or more of the central heat exchanger assemblies at a lower level above the ground. In a preferred arrangement the upper apices of the heat exchanger assemblies, or those upper apices of the outer ring of the heat exchanger assemblies, are approximately level with the lower end of the chimney part of the tower.

Preferably, the apices of the heat exchanger assemblies lie in parallel planes, or in two sets of parallel planes, at right angles, and at least some of the heat exchanger assemblies include frames or banks of different lengths. By providing frames or banks of different lengths, the plan area of the lower part of the tower in which the heat exchanger assemblies are located can be more nearly filled with useful heat exchanger surface than if all the frames were of the same length.

BRIEF DESCRIPTION OF THE DRAWINGS

The invention will now be described in detail by way of example with reference to the accompanying drawings, in which.

DESCRIPTION OF THE PREFERRED EMBODIMENT

Referring first to FIGS. 1 to 5, a natural draught tower is indicated generally at 20 and includes a chimney part 21 and apertured support means 22 between the lower end 23 of the chimney part and the ground 24.

Arranged within the lower end of the tower are six heat exchanger assemblies. Each of the assemblies includes a plurality of V-frames. Each frame comprises a plurality of finned tubes which are grouped together into two banks. Each bank comprises a plurality of parallel tubes arranged side by side and two such banks are associated with one another to form a V-frame being inclined to one another so that they diverge from a lower apex of the frame, the tubes of each bank being arranged with their longitudinal axes parallel to the apex of the frame.

Figure 5:
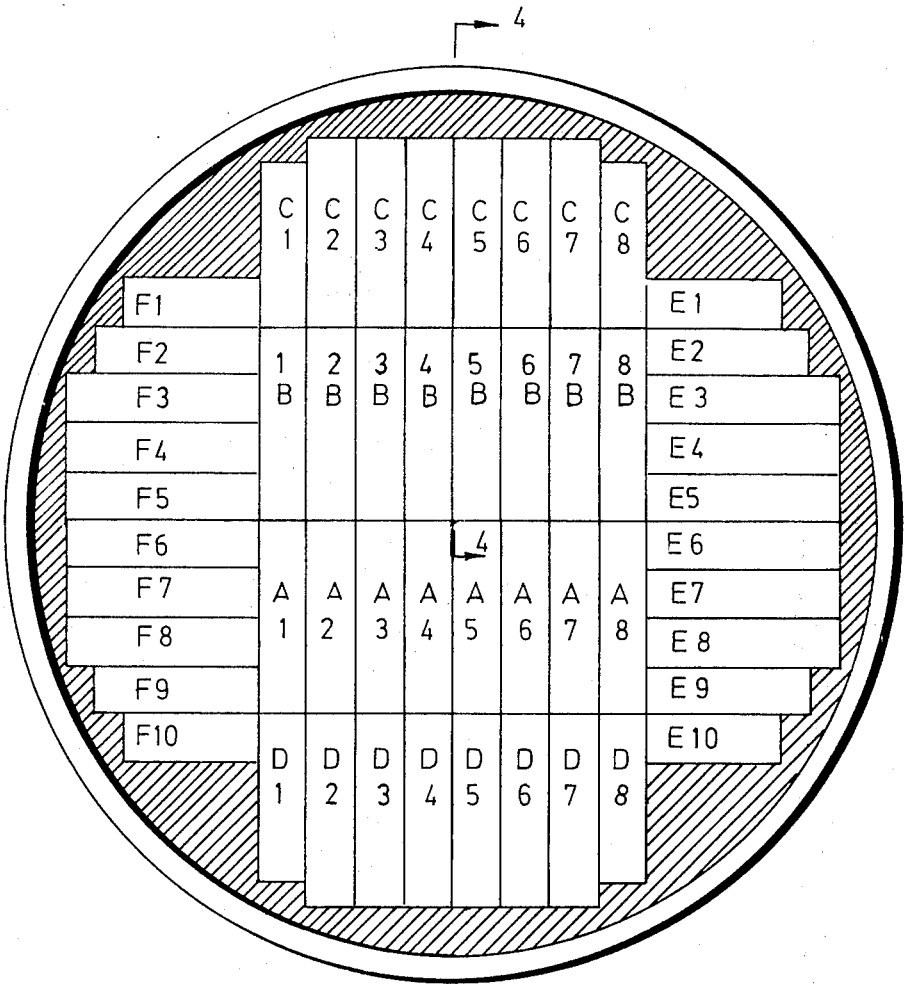
FIG. 5 is a diagrammatic plan view of the tower and heat exchanger assemblies showing the arrangement of the latter.

Referring to FIG. 5, there are arranged six heat exchanger assemblies within the lower portion of the tower 20. There are two central heat exchanger assemblies A and B each consisting of eight V-frames referenced A1–A8 and B1–B8 respectively. It will be noted that all the V-frames, each of which is represented by a full line rectangle, are of the same length.

Surrounding the heat exchanger assemblies A and B are four further heat exchanger assemblies C, D, E and F. The heat exchanger assemblies A and B are at a lower level above the ground line 24 than the heat exchanger assemblies C to F as is clearly shown in FIG. 4 for the V-frames B5 and C5.

Each of the heat exchanger assemblies C and D consists of eight V-frames C1–C8 and D1–D8. It will be seen that the V-frames C1 and C8 are shorter than the remaining V-frames in the heat exchanger assembly C and the V-frames D1 and D8 are shorter than the remaining V-frames in the heat exchanger assembly D.

The heat exchanger assemblies E and F each comprise ten V-frames. Taking for example the heat exchanger assembly E, the V-frames E3 to E8 inclusive are all of the same length, the V-frames E2 and E9 are shorter than the V-frames E3–E8 and the V-frames E1 and E10 are shorter than the V-frames E2 and E9. Similarly, the V-frames F2 and F9 are shorter than the V-frames F3–F8 and the V-frames F1 and F10 are shorter than the V-frames V-frames F2 and F9. It will be seen from FIG. 2 that the assembly of V-frames present a zig-zag shape in vertical section and from FIG. 5 that the apices of the shape lie in two sets of planes at right angles. Thus the apices of the V-frames in the heat exchanger assemblies A, B, C and D are parallel and are perpendicular to the apices of the V-frames in the heat exchanger assembly E and F.

Figure 3:
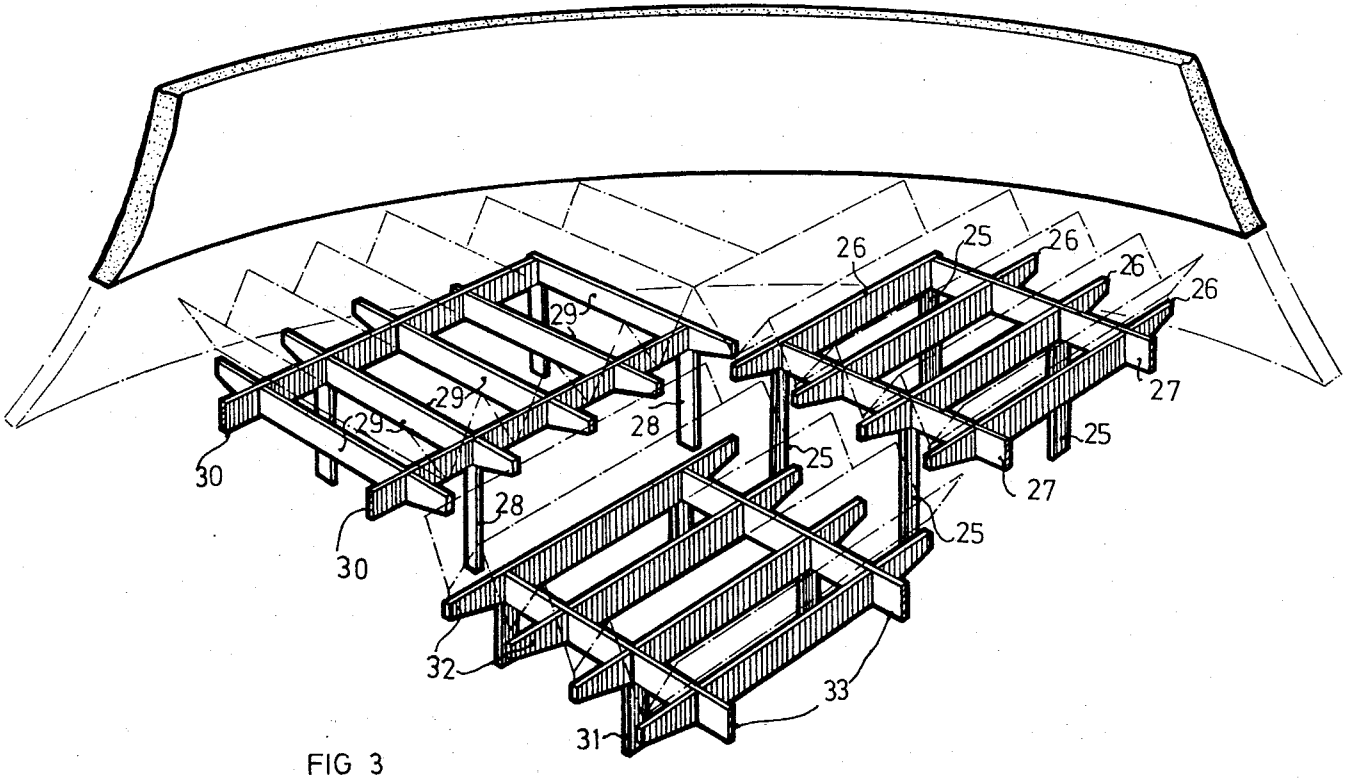
FIG. 3 is a perspective view showing the supports structure or the V-frames shown in FIG. 2.

Referring to FIG. 3, this shows part of the support structure for the V-frames and shows part of the support structure for the heat exchanger assemblies B, C and F.

The support structure for the heat exchanger assembly C comprises a plurality of pillars 25 which support a grid work of horizontal beams having longitudinal support beams 26 and tie beams 27. Each longitudinal support beam 26 is arranged to support the lower apex of the V-frame as will be described below. Similarly, the support structure for the heat exchanger assembly F comprises pillars 28, longitudinal support beams 29 and tie beams 30. The support structure for the heat exchanger assembly B comprises pillars 31, longitudinal support beams 32 and tie beams 33. As will be seen from FIG. 4, the pillars 31 are shorter than the pillars 25 thus supporting the V-frames of the heat exchanger assembly B at a lower level than the V-frames of the heat exchanger assembly C.

Figure 1:
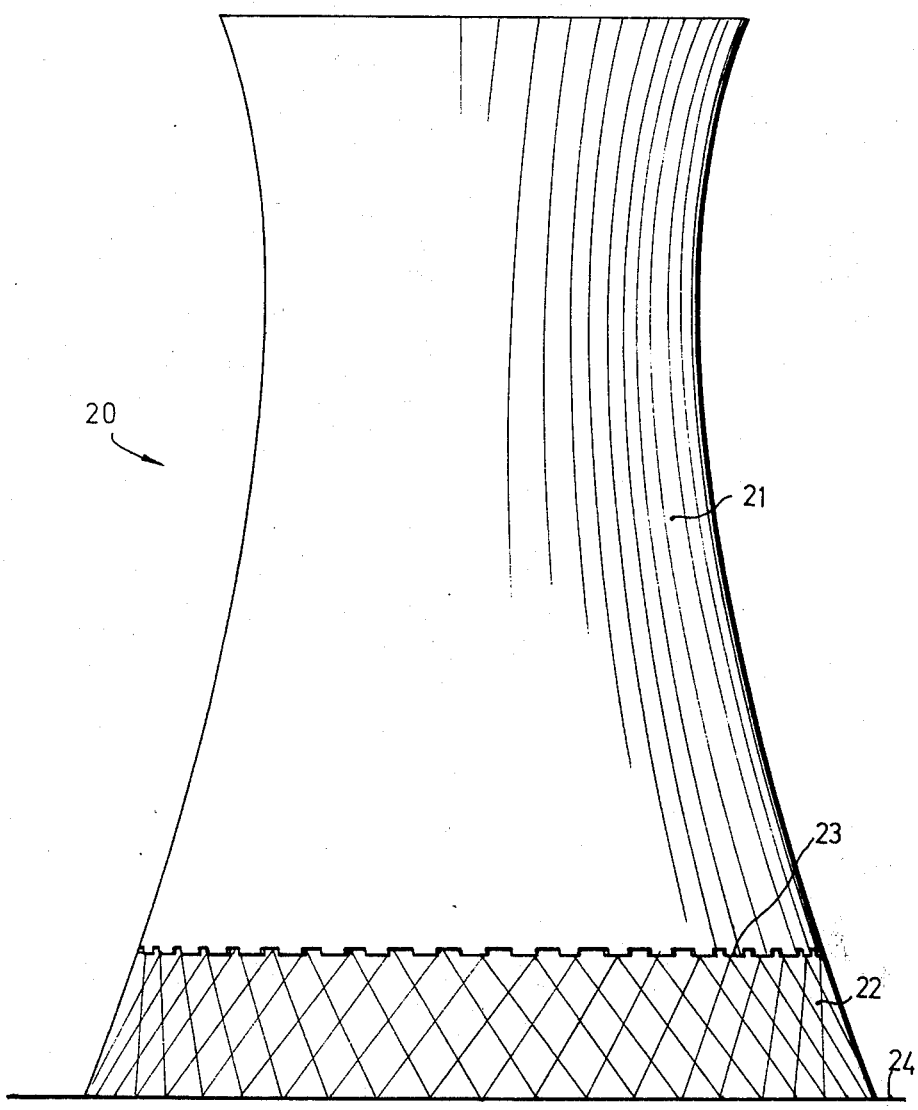
FIG. 1 is an elevation of a natural draught cooling tower containing a heat exchanger assembly.
Figure 2:
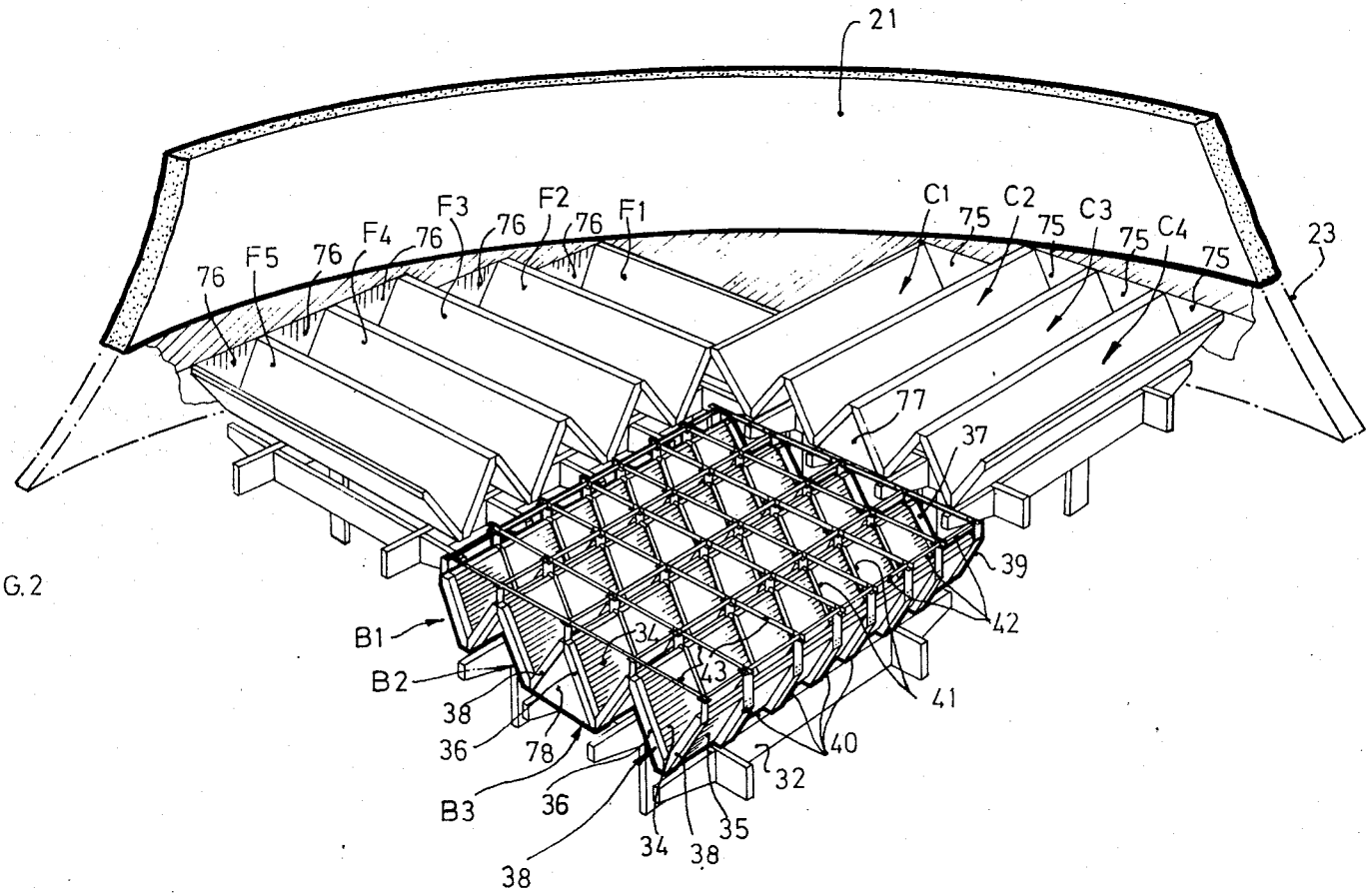
FIG. 2 is a perspective view, partly diagrammatic, of part of the arrangement of heat exchanger assemblies within the tower of FIG. 1.
Figure 4:
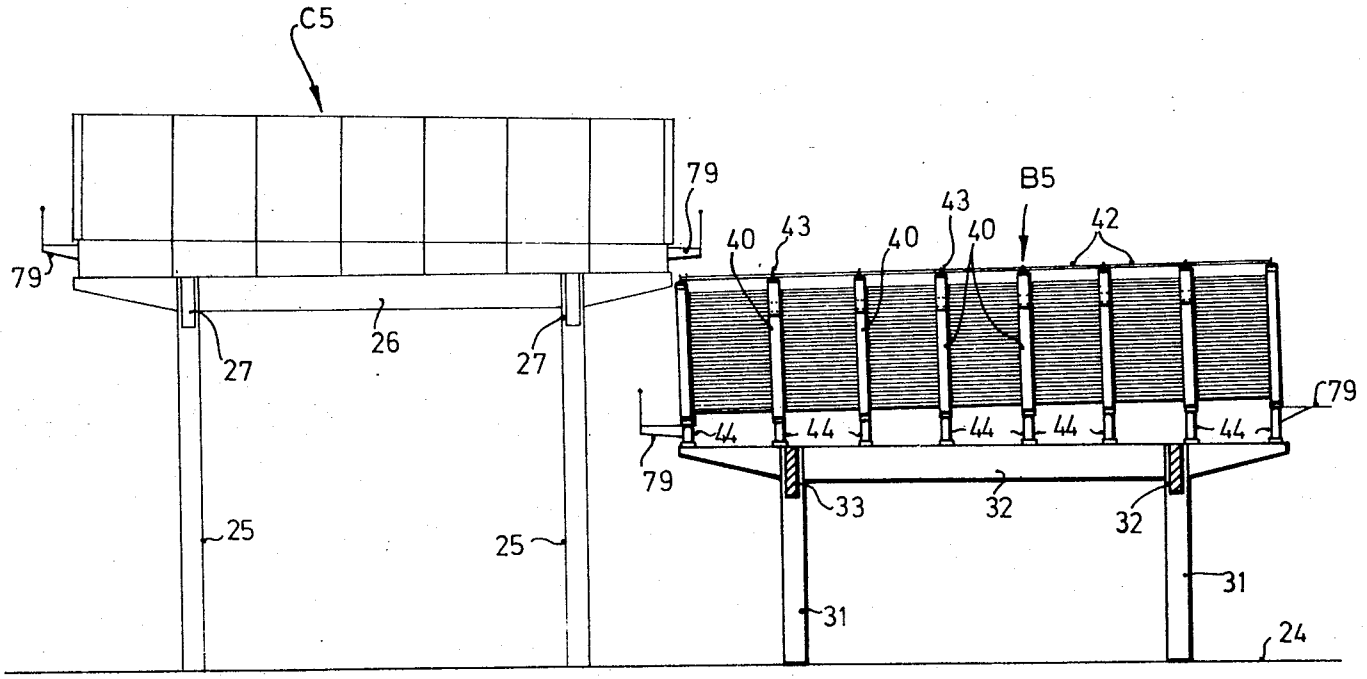
FIG. 4 is a section on the line 4—4 of FIG. 5 clearly showing the two levels of the inner and outer heat exchanger assemblies.

All the V-frames are of identical construction, apart from the length thereof, and the construction will be described generally in relation to the V-frames of the heat exchanger assembly B which are shown in FIGS. 2 and 4.

Each V-frame comprises two banks of finned tubes 34, 35 the tubes in each bank are parallel and extend parallel to the lower apex of the V-frame. The tubes of the bank 34 are connected at their ends to headers 36 and 37 and the tubes of the bank 35 are connected at their ends to headers 38 and 39. Between the headers, the tubes of each bank are supported by aligned pairs of transverse support members, some of the lower members being indicated at 40 and upper members at 41. As will be described below, the support members of each pair are connected together and are connected to the support members of the other bank of the frame. The interconnected support members are themseelves connected longitudinally of the frame by tie bars 42 and the upper edges of the banks of the V-frame are connected by further tie bars 43.

As will be seen from FIG. 4, as exemplified by the V-frame B5, the lower apex of each V-frame is supported from its associated longitudinal support beam by a plurality of upstanding columns 44 which raise the lower apex of the V-frame above the support beam 32. It will be seen from FIG. 4 also, that the upstanding columns 44 are not all of the same length so that the apex of the V-frame is slightly inclined to the horizontal at an angle, for example, of about 5°,to facilitate draining. It will be seen that the V-frame B5 slopes to the left in FIG. 4 whereas the V-frame C5, which is exemplary of the V-frames of the outer heat exchanger assemblies, slopes to the right i.e. towards the centre of the tower.

Figure 6:
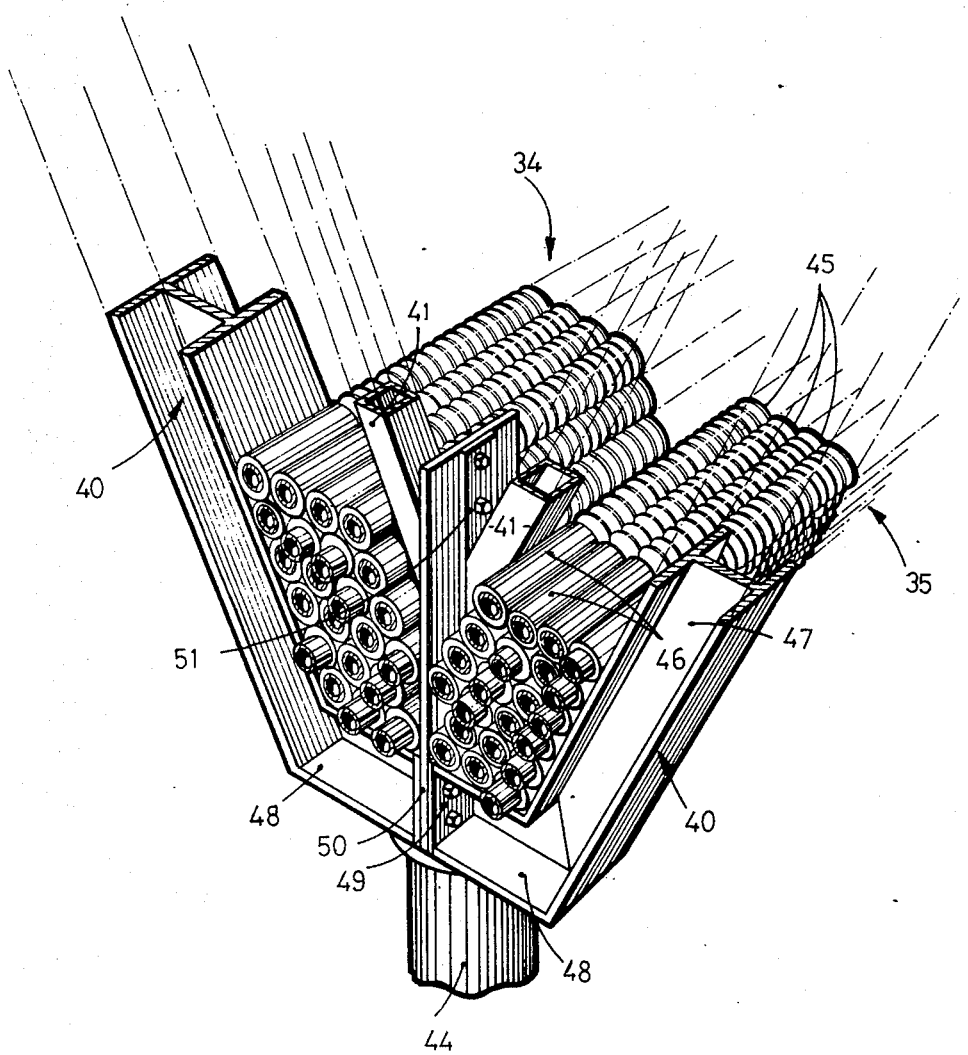
FIG. 6 is a detailed perspective view of part of a heat exchanger embodying the invention and showing the tube and support arrangement at the lower apex of the V-frame.

The detailed construction of each V-frame and the interconnection between V-frames will now be described with reference to FIGS. 6 to 8. Referring first to FIG. 6, this shows in detail the arrangement at the lower apex of a V-frame and the two banks of the V-frame are indicated generally at 34 and 35. Each bank consists of a plurality of finned tubes, some of which are indicated at 45. The fins may be placed on the tube in any convenient manner. Where the tubes are to be supported by the upper and lower transverse supports 42 and 40 they are provided with collars made, for example, of zinc. Such collars are indicated at 46. Each lower support member 40 is in the form of an I-beam which has an inclined portion 47 and a horizontal portion 48 which extends beneath the tubes of the bank. A flange plate 49 is connected between the flanges of the I-beam at the free end of the horizontal portion 48 and is bolted through a common member 50 which is in the form of a vertical plate to a similar flange plate on the other lower transverse support of the bank 34. It will be seen that the common member 50 extends about a medial plane of the V-frame, which plane in FIG. 6 is vertical, the medial plane extending through the lower apex of the V-frame parallel to the tubes in the banks and bisecting the angle between the banks. Each upper transverse support 42 is of square section tube and at its lower end has a flange plate 51 which is bolted through the common member 50 to a similar flange plate on the upper transverse support 42 of the bank 34. The lower end of the common member 50 is secured to one of the columns 44 on the upper end of which rest the horizontal portions 48 of the lower transverse supports 40. It will be appreciated that the construction shown in FIG. 6 is repeated for each aligned pair of upper and lower transverse supports 42 and 40 and that each column 44 is aligned with, and in turn supports, the transverse supports 40 and thus the tubes.

It will be seen that the lower apex of the A-frame is filled with finned tubes. Except in alignment with the supports 40, 42, air can flow generally vertically through the apex of the frame. Since, as will be seen, the tubes are arranged in rows, the air, although it will flow through the apex generally vertically will follow a serpentine path since the tubes in adjacent rows are staggered. This will be explained in further detail with reference to FIG. 8 to which reference is now made.

Figure 8:
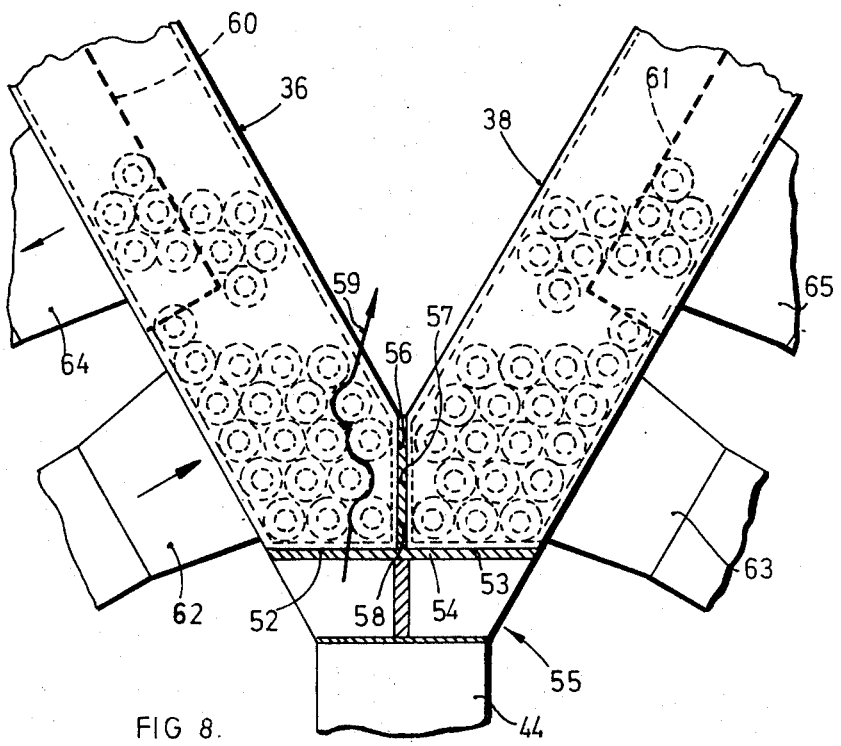
FIG. 8 is a view showing the lower part of a header of a heat exchanger in the form of a V-frame.

FIG. 8 shows the lower end portions of the headers 36 and 38 at the one ends of the bank 34 and 35 respectively. The headers 36 and 38 have horizontal lower surfaces 52 and 53 respectively which rest upon the upper flange 54 of a short I-beam 55 which rests on one of the columns 44. The headers 36 and 38 also have vertical surfaces 56 and 57 between which is received a common member 58 which is vertical and as described in relation to the common member 50 lies in the medial plane of the frame.

It will be clearly seen from the finned tubes which are shown in dotted lines that these fill the lower apex of the V-frame. Thus air can pass vertically upwardly through the apex although the actual path of the air will be serpentine as indicated by the arrow 59, the general direction of flow of the air through the apex will be vertical. It will be seen, also, that the air has to flow over a number of tubes in succession as it flows through the apex. As illustrated, the air has to flow over the tubes of five generally horizontal rows of tubes.

Each of the headers 36 and 38 is divided and a pass plate is indicated generally at 60 for the header 36 and at 61 for the header 38; there are provided inlet nozzles 62 and 63 and outlet nozzles 64 and 65. It will be appreciated that the medium to be cooled or condensed enters the headers 36 and 38 through the inlet nozzles 62 and 63, flows through the tubes which are in communication with the part of the header fed by the inlet nozzle to the headers 37 and 39 and then flows back along the tubes which are in communication with the outlet nozzles 64 and 65.

As will be seen from FIG. 2, adjacent V-frames of each heat exchanger assembly are arranged side by side and they are interconnected as will now be described in relation to FIGS. 7 and 9. FIG. 7 shows the interconnection of the transverse supports of two adjacent banks of tubes to adjacent the frames. For example the banks may be the bank 35 of the V-frame B3 and the bank 34 of the V-frame B4.

Figure 7:
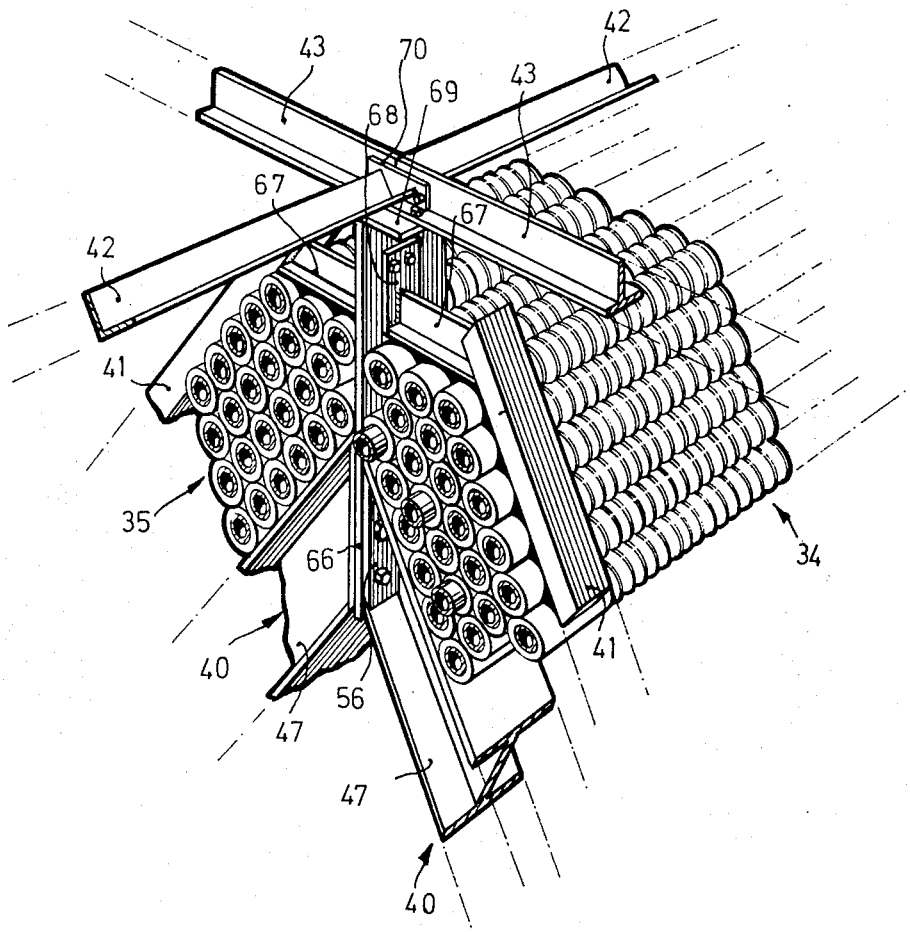
FIG. 7 is a view similar to FIG. 6 showing the tube and support arrangement at the connection between adjacent banks of tubes of adjacent V-frames.

Referring to FIG. 7, at their upper ends, the sloping portions 47 of the lower transverse supports 40 are provided with flange plates, one of which is shown at 56 and which are bolted together with the interposition of a common member 66 in the form of a vertical plate. At their upper ends, the upper transverse supports 42 are welded to horizontal T-bars 67 whose free ends are welded to flange plates, one of which is shown at 68, and these flange plates are bolted together with the interposition of the common member or plate 66. It will be seen that the common members or plates 66 lie in the median plane of the apex of the zig-zag shape formed by the two V-frames, the median plane bisecting the angle between the banks 34 and 35 and passing through the apex between the banks. It will be seen that, except where the tubes of the banks are supported by the transverse supports 40 and 41, air may flow through the apex and it will have to flow over a number of tubes in succession due to the arrangement of the tubes in rows in a manner similar to that described in relation to FIG. 10 and as will be described below in relation to FIG. 9.

Each common member 66 has welded to its upper end a horzontal plate 69 to which the tie bars 43 are bolted. The tie bars 43 are of inverted T-section and the cross member of the T is bolted to the plate 69. The longitudinal tie bars 42 are provided at their ends with flange plates 70 which are in turn bolted to the stems of the T's of the tie bars 43. It will be seen that the tie bars 42 are of angle section.

Figure 9:
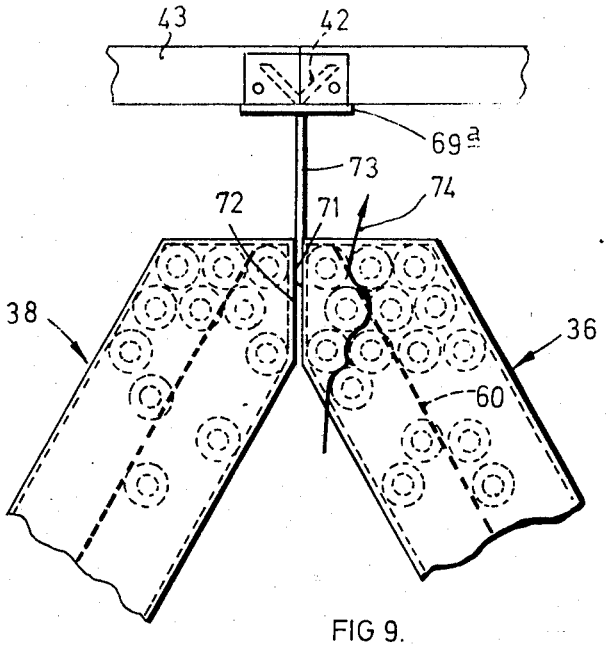
FIG. 9 is a view similar to FIG. 8 but showing the connection between the headers of two adjacent banks and two adjaacent frames.

FIG. 9 shows that the means of interconnecting the upper ends of two headers of two adjacent banks to adjacent frames is somewhat similar to the method of interconnecting the transverse supports. Thus there is shown in FIG. 9, by way of example, the upper end of the header 36 of the V-frame B4 and the upper end of the header 38 of the V-frame B3. The upper ends of the headers 36 and 38 are provided respectively with vertical surfaces 71 and 72 which lie on either side of a common member 73 which is in the form of a vertical plate and which, as described above, lies about the median plane between the banks which meet at the apex. The upper ends of the headers are connected to the common plate by means not shown. At the upper end of the common member or plate 73 is welded a horizontal plate 69*a* which is similar to the plate 69 in FIG. 7 and to which tie bars 43 from adjacent headers are bolted and to these tie bars 41 are bolted the ends of tie bars 42, from the common members 66 of the adjacent transverse members. It will be clearly seen from FIG. 9 that the apex between the two banks is filled with tubes and that air can flow generally vertically through the apex as indicated by the arrow 74. While the actual path of the air through the apex is serpentine, the general direction of flow is vertical i.e. is generally parallel to the median plane through the apex.

Each V-frame provides a stable structure with the transverse supports 40 and 41 and the headers connected at the lower apex of the V and with the upper edges of the V interconnected by the tie bars 43 and with the transverse supports longitudinally stabilised by the tie bars 42. Moreover, adjacent V-frames are stably interconnected by the arrangements shown in FIGS. 7 and 9 so that each heat exchanger assembly is extremely stable and is supported clear of the longitudinal beams such as 32 of the support structures by the columns 44 thus allowing air to pass through the tubes at the lower apices of the zig-zag shape formed by the interconnected V-frames. We have found that we can obtain an increase of useful heat exchanger surface of the order of 9% by filling the apices of the frames and the heat exchanger assemblies with finned tubes as compared with the prior construction where the apices were fitted with blanking plates which not only wasted space but also gave rise to pressure drops.

Air enters the tower 20 through the apertured support means 22 and flows under the V-frames which are spaced above the ground on their supporting structures as indicated in FIG. 4 and then flows upwardly through the V-frames. Sealing means must be provided to prevent the air from flowing up the tower without passing through the finned tubes. Thus the outer ends of all the V-frames in each heat exchanger assembly, i.e. the ends nearer the periphery of the tower, are provided with blanking plates some of which are shown in FIG. 2. Thus the blanking plates for the V-frames of the heat exchanger assembly C are indicated at 75 and those for the heat exchanger assembly F at 76. Although not shown, there will be similar blanking plates for the outer ends of the V-frames of the heat exchanger assembly B i.e. the ends adjacent the headers 37 and 39. There will also be blanking plates, not shown, between the inner ends of adjacent V-frames. Thus one such blanking plate between the V-frames C2 and C3 is shown at 77. The other similar plates are omitted to give a clear view of the supporting structure. Similarly the inner ends of the adjacent V-frames of the heat exchanger assemblies A and B will be blanked off and one such blanking plate is indicated at 78, the remaining blanking plates being omitted so as to show clearly the supporting structure. In addition, the whole of the plan area not covered by the V-frames will be filled with blanking plates as indicated by the shaded area in FIG. 5 and FIG. 2. We have found that by using V-frames of different sizes it is possible to utilize a greater part of the plan area of the tower than if using V-frames which are all of the same size and we have found that an increase in useable area of up to 20% can be obtained.

Walkways may be provided for maintenance purposes and to enable access to be had to the headers of the V-frames and such walkways are indicated for the heat exchanger assemblies B and C at 79.

Figure 10:
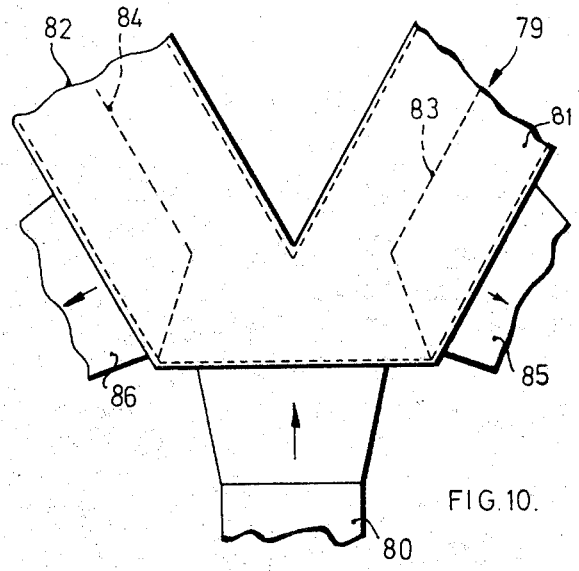
FIG. 10 is a detailed view showing a single form of header for a V-frame.

When the assembly is in operation, fluid to be cooled or condensed is passed into the headers of the various V-frames such as the headers 36 and 38 through the inlet nozzles 62 and 63, and passes along the tubes as described above and out through the outlet nozzles 64 and 65. Air enters the tower through the apertured support means 22 and flows under the heat exchanger assemblies and then is pulled through the heat exchanger assemblies by the chimney draught provided by the warmed air which is rising through the chimney. It will be noted from FIG. 2 that the upper apices of the heat exchanger assemblies are substantially level with the lower end 23 of the chimney part 21 of the tower. By way of example, this lower end may be fifty feet above the ground level and the lower apices of the V-frames in the lower heat exchanger assemblies A and B may be at a height approximately 23 feet above the ground. Known means may be provided for causing the medium to be cooled or condensed to flow through the banks of tubes and the slope on the V-frames as shown in FIG. 4 assist in draining them. As described, there are, at each end of each V-frame, two separate headers. FIG. 10 shows part of a single header which may be provided at one end of each V-frame. The header is of generally V shape and is indicated generally at 79. It has a single inlet nozzle 80 and each limb of the header, the limbs being indicated at 81 and 82, is provided with a pass plate, the pass plates being indicated at 83 and 84 respectively. Outlet nozzles 85 and 86 are provided for the limbs 81 and 82 respectively the outlet nozzles communicating with the parts of the headers divided from the inlet nozzles by the pass plates. The flow through the tubes will be as described in relation to the previous embodiment.

Figure 11:
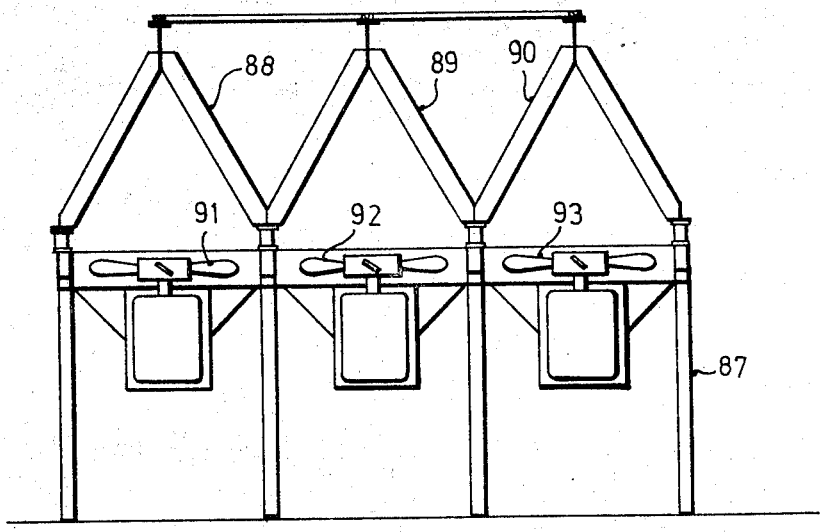
FIG. 11 is a diagram showing a heat exchanger assembly embodying the invention in combination with fan means to force air over the tubes of the heat exchanger assembly.

The invention has been specifically described in relation to heat exchanger elements associated with a natural draught tower but it is within the scope of the invention to associate these heat exchanger elements with means for providing a forced or induced draught. Such an arrangement in which a forced draught is provided is indicated somewhat diagrammatically in FIG. 11 which also illustrates a further modification of the invention. The banks of tubes which have been described have been arranged in V-frames in which the banks diverge from the lower apex of the V. Equally, however, the banks could have been arranged in A-frames in which the banks diverge from the upper apex of the A. To some extent, this is a question of terminology where, as described in relation to FIGS. 2, 8 and 9, each bank has separate headers since one may consider two adjacent banks either to be a V-frame or an A-frame. Where one has a single header, however, as in FIG. 10 then the banks would be arranged in V-frames.

Returning now to FIG. 11, there is a supporting structure indicated generally at 87 on which are mounted three adjacent A-frames 88, 89 and 90, the A-frames being arranged adjacent one another so that in vertical section they present an assembly having a zig-zag section. Under each A-frame is a fan or more the one fan, single fans being indicated at 91, 92, 93, each fan being arranged to be driven by a suitable motor. The ends of the A-frames are blanked off and the fans force air to flow over the A-frames. The A-frames are constructed substantially as described above in relation to the V-frames in that their upper apices are provided with tubes and the connections between lower edges of adjacent A-frames are also tubed so that they will look rather like rather like the arrangement shown in FIG. 8.

It will be seen that the invention provides an improved heat exchanger in the form of a V or A frame having tubes at the apex thereof and also an improved heat exchanger assembly comprising a plurality of such V-frames or A-frames arranged side by side with the upper and lower apices of the resulting zig-zag shape containing tubes over which the air can flow, thus increasing the usable heat exchanger surface as compared with previous arrangements.

I claim:

1. A heat exchanger assembly in which fluid to be cooled is passed through a plurality of finned tubes over which air flows, the tubes being grouped together into banks, each bank comprising a plurality of parallel finned tubes arranged side by side; the assembly comprising a plurality of such banks arranged side by side with each adjacent pair of banks diverging from an apex and forming an A or V frame so that the assembly has a zig-zag shape in section perpendicular to the length of the tubes and with each apex of the shape substantially filled with the finned tubes of adjacent banks so that air can flow through the apex in a direction generally parallel to a median plane of the apex parallel to the tubes and bisecting the angle between the banks meeting at said apex, the air in flowing through each said apex passing over a plurality of said tubes in succession; and a supporting framework having longitudinal support members extending parallel to the tubes and aligned with the lower apices of the assembly, the support members being provided with a plurality of upstanding columns on which the frames are supported with the lower apices of the assembly spaced above the longitudinal support members.

2. A heat exchanger assembly according to claim 1 including means to force or induce a flow of air over the tubes.

3. The combination of at least one heat exchanger assembly according to claim 1 with a natural-draught tower comprising a chimney part and apertured support means between the lower end of the chimney part and the ground, the heat exchanger assembly being arranged within the lower part of the tower and spaced above the ground so that air can enter the tower through the support means and pass across the bottom of the heat exchanger assembly and flow upwardly through the heat exchanger assembly.

4. The combination of claim 3 including a plurality of heat exchanger assemblies arranged with an outer ring of heat exchanger assemblies at a higher level above the ground and surrounding one or more central heat exchanger assemblies at a lower level.

5. The combination according to claim 3 wherein the upper apices of the heat exchanger assemblies or those of the outer ring of heat exchanger assemblies are approximately level with the lower end of the chimney part of the tower.

6. The combination according to claim 3 including a plurality of heat exchanger assemblies and wherein the apices of the heat exchanger assemblies lie in parallel planes, or in two sets of parallel planes at right angles, and wherein at least some of the heat exchanger assemblies include frames or banks of different lengths.

7. A heat exchanger assembly according to claim 1 wherein each bank of tubes has a separate header at each end to which the tubes of the bank are connected and wherein, at each apex of the assembly, adjacent headers have adjacent surfaces parallel to the median plane of the frame, the headers being connected to a common member interposed between said adjacent surfaces.

8. A heat exchanger assembly according to claim 7 wherein one header of each bank is divided and is provided with inlet and outlet nozzles.

9. A heat exchanger assembly according to claim 7 wherein the tubes of each bank are supported, between headers, by a plurality of pairs of aligned transverse supports, the pairs of supports being spaced apart along the lengths of the tubes and arranged so that the latter lie between the supports of each pair, the pairs of supports of each bank being aligned with the pairs of supports of each of the other banks with the supports of each two adjacent aligned pairs being connected to a common member lying about the median plane of the frame formed by an adjacent two of said banks and passing between the tubes immediately adjacent to said plane at the apex of the frame, and wherein the common members along each apex of the assembly are connected together.

10. A heat exchanger assembly according to claim 1 wherein the banks of the frame have a common header at each end of the frame and to which the tubes of the frame are connected.

11. A heat exchanger assembly according to claim 10 wherein one of the headers of the frame is divided and has a common inlet nozzle for both banks at the apex of the frame and separate outlet nozzles.

* * * * *